US006984928B2

(12) United States Patent
Mineta et al.

(10) Patent No.: US 6,984,928 B2
(45) Date of Patent: Jan. 10, 2006

(54) COIL FILAMENT

(75) Inventors: Takao Mineta, Tokyo (JP); Brett Michael Coleman, Tokyo (JP)

(73) Assignee: Mineta Company Ltd., Tokyo (JP)

( * ) Notice: Subject to any disclaimer, the term of this patent is extended or adjusted under 35 U.S.C. 154(b) by 177 days.

(21) Appl. No.: 10/344,800

(22) PCT Filed: Mar. 5, 2002

(86) PCT No.: PCT/JP02/02020

§ 371 (c)(1),
(2), (4) Date: Feb. 14, 2003

(87) PCT Pub. No.: WO03/075317

PCT Pub. Date: Sep. 12, 2003

(65) Prior Publication Data

US 2005/0001531 A1 Jan. 6, 2005

(51) Int. Cl.

| | |
|---|---|
| ***H01J 1/16*** | (2006.01) |
| ***H01J 61/04*** | (2006.01) |
| ***H01K 1/14*** | (2006.01) |
| ***K01J 17/04*** | (2006.01) |

(52) U.S. Cl. ..... 313/344; 313/628; 313/631

(58) Field of Classification Search ..... 313/344, 313/628, 341, 631

See application file for complete search history.

(56) References Cited

U.S. PATENT DOCUMENTS

| | | | | |
|---|---|---|---|---|
| 2,167,765 | A * | 8/1939 | McGowan | 313/344 |
| 2,731,581 | A * | 1/1956 | Krefft | 313/343 |
| 3,400,294 | A * | 9/1968 | Kling | 313/340 |
| 4,506,187 | A * | 3/1985 | Hofmann et al. | 313/341 |
| 4,611,146 | A * | 9/1986 | Morrison | 313/446 |
| 4,745,325 | A * | 5/1988 | Koizumi | 313/345 |
| 5,143,447 | A * | 9/1992 | Bertenshaw | 362/297 |
| 5,729,082 | A * | 3/1998 | Snijkers | 313/346 R |

FOREIGN PATENT DOCUMENTS

| | | |
|---|---|---|
| GB | 2324907 | 11/1998 |
| JP | 621360 | 1/1987 |
| JP | 03217272 | 3/1993 |
| JP | 05135750 | * 6/1993 |
| WO | WO 93/01613 | 1/1993 |
| WO | WO9927297 | 6/1999 |
| WO | WO0052737 | 9/2000 |

* cited by examiner

OTHER PUBLICATIONS

International Search Report dated Mar. 5, 2002.

*Primary Examiner*—Mariceli Santiago
*Assistant Examiner*—Elizabeth Rielley
(74) *Attorney, Agent, or Firm*—Trexler, Bushnell, Giangiorgi, Blackstone & Marr, LTD

(57) ABSTRACT

A coiled filament has a light emitter with a reduced volume as best possible to serve in downsizing a light bulb and elevate an illumination with high efficiency in an illuminated field. A flat coiled filament wound into flatness is arranged in the form of a helix or ring, locating the longer axis of the flatness in parallel with the central axis of the coiled filament or to cross the central axis at an appropriate angle. Alternatively, it is arranged in coincident with the radial axis of the coiled filament or at an appropriate angle. Alternatively, the flat coiled filament is U-shaped and a pair of such U-shaped flat coiled filaments are mated with each other through their open ends, while the inner surfaces of their closed ends are kept in non-contact with each other. Alternatively, the flat coiled filament is formed circular.

9 Claims, 16 Drawing Sheets

(a)

(a)

(b)

(c)

(a)

(b)

(a)

(b)

COIL FILAMENT

RELATED/PRIORITY APPLICATION

This application is a National Phase application of International Application No. PCT/JP02/02020, filed Mar. 5, 2002.

FIELD OF THE INVENTION

The present invention relates to a coiled filament having a light emitter with a reduced volume as best possible to serve in downsizing a light bulb and elevate an illumination with high efficiency in an illuminated field.

BACKGROUND OF THE INVENTION

Generally, for increasing the amount of filament per unit volume to downsize a light bulb and elevate an illumination in an illuminated field, methods of arranging multiple coiled filaments closely, and of winding coils double, triple or quadruple have been known, for example. These methods have limitations, however, in increasing the amount of filament per unit volume. Recently, plane form of the coiled filament itself is designed in different forms, such as elliptic and polygonal, rather than circular to increase the amount of filament per unit volume. For example, plane form of the coiled filament may be changed from circular into flat. Alternatively, as disclosed by the Inventor(s) in Coiled filament for Light Bulbs (see Japanese Patent Application Laid-Open No. 2000-82444), a cylindrical coil in plane form, or circular seen from a plane, of the coiled filament can be altered. In this case, the coil rim is bent toward the center of the circle to reduce the plane area. These methods are capable of increasing the amount of filament per unit volume, downsizing a light bulb closer to a spotlight compared to the conventional coiled filament, and improving the radiation efficiency.

As descried above, if plane form of the coiled filament may be shaped flat in plane form, or the rim of the circle in plane form of the coiled filament may be bent toward the center of the circle, it is possible to increase the amount of filament per unit volume compared to the conventional cylindrical coiled filament. This is effective to downsize a light bulb and improve the radiation efficiency to some extent. However, it is desired to develop such a coiled filament that serves in further downsizing the light bulb with higher radiation efficiency.

The present invention is intended to solve the above problems in the art and accordingly has an object to provide a coiled filament having a light emitter with a reduced volume as best possible, which can serve in downsizing a light bulb and elevate an illumination with high efficiency in an illuminated field.

SUMMARY OF THE INVENTION

To solve the above problems, a coiled filament according to a first aspect of the invention comprises a straight flat coiled filament wound into flatness in the form of a straight line, wherein the longer axis of the flatness is located in parallel with the central axis of a double coiled filament formed by further winding the straight flat coiled filament, and the straight flat coiled filament is arranged helically about the central axis. In this case, instead of arranging the straight flat coiled filament helically about the central axis of the double coiled filament, the straight flat coiled filament may be ring-shaped about the central axis, and a plurality of such ring-shaped flat coiled filaments may be arranged in parallel with the axial direction of the central axis. When a double coiled filament is formed, it is not limited to a circular double coiled filament but may be formed in a flat double coiled filament.

Thus, on production of the coiled filament, the flat coiled filament may be helically wound to produce the double coiled filament, or the flat coiled filament may be ring-shaped to produce the double coiled filament with multiple such ring-shaped filaments arranged in parallel. Compared to the conventional double coiled filament formed helical or ring-shaped using the cylindrically wound filament, the flat coiled filament wound in flat cylindrical form of the present invention is advantageous to form a double coiled filament with a smaller winding diameter of the double coil reduced by the extent of the flatness. Accordingly, it is possible to increase the amount of filament per unit volume, downsize the light bulb smaller and elevate the illumination in the illuminated field higher than the conventional types are. Further, on production of the double coiled filament, if preferably it is formed in a flat cylindrical double coiled filament, a plurality of such flat cylindrical double coiled filaments can be arranged to further increase the amount of filament per unit volume.

A coiled filament according to a second aspect of the present invention comprises a straight flat coiled filament wound into flatness in the form of a straight line, wherein the longer axis of the flatness filament is located at an appropriate angle including right angle to cross the central axis of a double coiled filament formed by further winding the straight flat coil, and the straight flat coiled filament is arranged helically about the central axis. Also in this case, instead of arranging the straight flat coiled filament helically about the central axis of the double coiled filament, the straight flat coiled filament may be ring-shaped about the central axis, and a plurality of such ring-shaped flat coiled filaments may be arranged in parallel with the axial direction of the central axis. When a double coiled filament is formed, it is not limited to a circular double coiled filament but may be formed in a flat double coiled filament.

Thus, on production of the coiled filament, the flat coiled filament in the form of a straight line wound into flatness is arranged, locating the longer axis of the flatness at an appropriate angle including right angle to cross the central axis of a double coiled filament formed by further winding a straight flat coiled filament. As a result, compared to the first aspect of the invention, it is possible to further narrow a gap between each flat coiled filament and increase the amount of filament per unit volume.

A coiled filament according to a third aspect of the invention comprises a plurality of flat coiled filaments wound into flatness in the form of straight lines, wherein the straight lines are located in parallel with a pre-determined central axis, and the longer axes of the flatness of the straight flat coiled filaments are located at an appropriate angle to cross the radial directions of the pre-determined central axis including the radial direction. In this case, the straight flat coiled filaments may be located by an appropriate number, matching the longer axes of the flatness thereof with the axes in the radial directions of a pre-determined central axis, or they may be located by an appropriate number, setting the longer axes to cross the axes in the radial directions at an appropriate angle. Alternatively, as a combination of them, a plurality of straight flat coiled filaments may be arranged in parallel longitudinally and laterally about the central axis seen from a plane.

Thus, the plural flat coiled filaments in the form of straight lines are arranged, locating the straight lines in parallel with a pre-determined central axis, and locating the longer axes of the flatness of the straight flat coiled filaments at an appropriate angle to cross the radial directions of the pre-determined central axis including the radial direction. As a result, one end in the longitudinal direction of each of the plural flat coiled filaments can be approached to the central axis as close as an approach limit. Therefore, it is possible to extremely increase the amount of filament per unit volume when the flat coiled filaments are arranged as many as an arrangement limit.

A coiled filament according to a forth aspect of the invention comprises a flat coiled filament wound into flatness in the form of a straight line and further U-shaped, wherein a pair of such U-shaped flat coiled filaments are inserted into each other through their open ends, and inner surfaces of their closed ends are kept non-contact with each other. In this case, the U-shaped flat coiled filaments are not limited to a pair but a plurality of pairs may be inserted mutually through their open ends.

Thus, the flat coiled filament is U-shape, and a pair of such U-shaped flat coiled filaments are mated with each other through their open ends, while the inner surfaces of their closed ends are kept non-contact with each other. As a result, it is possible to increase the amount of filament per unit volume and easily produce the coiled filament because the arrangement is simple.

A coiled filament according to a fifth aspect of the invention comprises a flat coiled filament wound into flatness in the form of a straight line and further formed circular, wherein an appropriate number of flat coiled filaments are arranged within a circle of such a circular ring-shaped double coiled filament in the central axis direction of the circle. In this case, the flat coiled filament arranged in the central axis direction of the circular ring-shaped double coiled filament may comprise a straight flat coiled filament, or a circular ring-shaped double coiled filament with a smaller diameter than that of the circular ring-shaped double coiled filament. Alternatively, a plurality of the flat coiled filaments arranged in the central axis direction of the circular ring-shaped double coiled filament may sandwich the circular ring-shaped double coiled filament to be located before and behind the central axis thereof. Alternatively, these aspects may be combined appropriately.

Thus, the flat coiled filament in the form of a straight line is formed circular, and within a circle of such a circular ring-shaped double coiled filament, an appropriate number of flat coiled filaments are arranged in the central axis direction of the circle. Therefore, it is possible to increase the amount of filament per unit volume. In addition, as the illuminated field can be formed circular rather than rectangular, it is possible to reduce the light emission loss at the light emitter on the corner of the rectangle as far as possible to achieve a high efficiency of light emission.

DETAILED DESCRIPTION OF THE PREFERRED EMBODIMENTS

Embodiments of the coiled filament according to the present invention will be described below based on the drawings.

Figure 1:
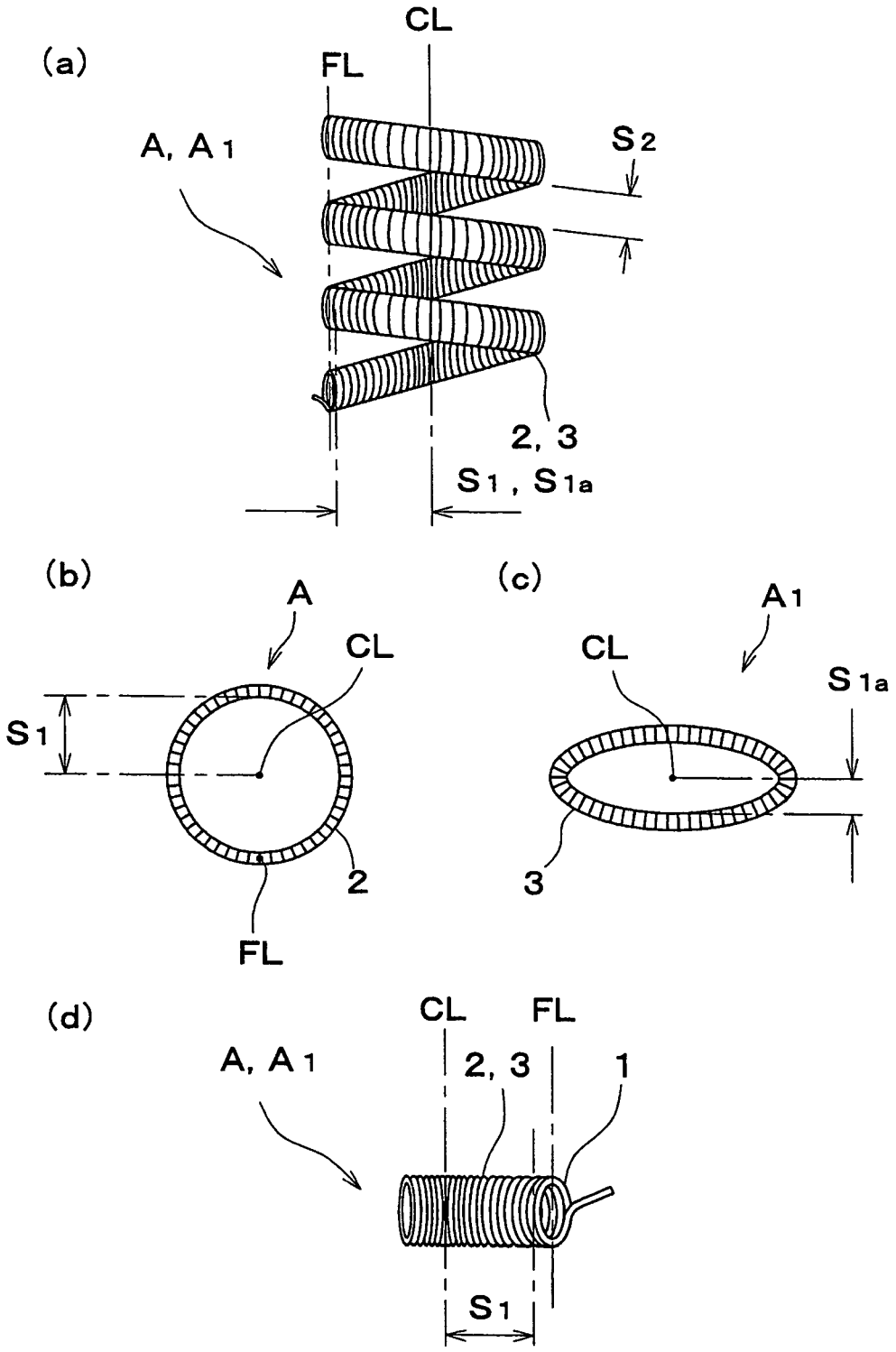
FIG. 1 shows a first embodiment of the coiled filament according to the present invention: (a) a front view of a double coiled filament formed by helically winding a flat coiled filament; (b) a plan view of the double coiled filament formed cylindrical; (c) a plan view of the double coiled filament formed flat cylindrical; and (d) a partly enlarge view of the double coiled filament.

First Embodiment (FIG. 1)

The figure shows (a) a front view of a double coiled filament formed by helically winding a flat coiled filament; (b) a plan view of the double coiled filament formed cylindrical; (c) a plan view of the double coiled filament formed flat cylindrical; and (d) a partly enlarge view of the double coiled filament.

A straight flat coiled filament 1 wound into flatness and formed in an elongated straight line is employed to form a cylindrical or flat cylindrical double coiled filament 2, 3 having a central axis CL, as shown in FIG. 1(*a*)–(*d*). Locating its longitudinal axis FL in parallel with the central axis CL, the straight flat coiled filament 1 is wound helically to produce an objective coiled filament A, A1.

In this case, spacing S1, S1*a*, between the central axis CL of the double coiled filament 2, 3 and the inner rim of the cylindrical double coiled filament 2 formed in a cylindrical double coil or the inner rim at the shorter side of the flat cylindrical double coiled filament 3 formed in a flat, cylindrical double coiled filament, and spacing S2, between each coil of the helically-wound double coiled filament 2, 3, are designed as narrow as possible outside a range that causes arc-related troubles to increase the amount of filament per unit volume. When the straight flat coiled filament 1 is employed to form the cylindrical or flat cylindrical double coiled filament 2, 3, for example, it is formed into the flat cylindrical double coiled filament 3 as shown in FIG. 1(*c*), the spacing S1*a* between the inner rim at the shorter side and the central axis CL can be designed much shorter than the spacing S1 in the cylindrical double coiled filament 2. Therefore, if cylindrical double coiled filaments having plural central axes are located arranging the shorter sides in line, it is possible to increase the amount of filament per unit volume by the extent accordingly.

For convenience of description in the following embodiments, the straight flat coiled filament 1 is shown as wounded into a single coil, though it is free to form it into a double coil (ditto in each following embodiment).

Figure 2:
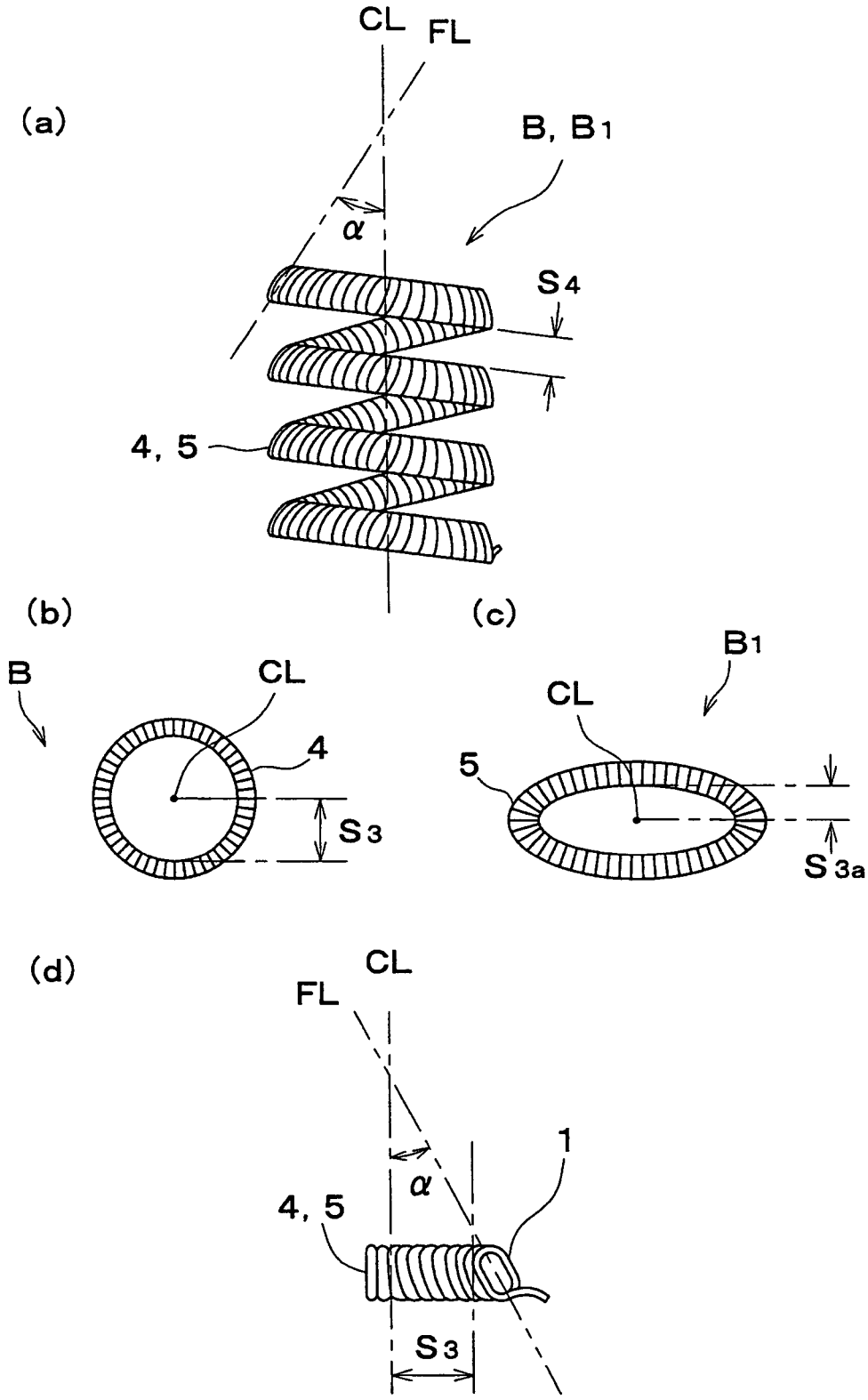
FIG. 2 shows a second embodiment of the coiled filament according to the present invention: (a) a front view of a double coiled filament formed by helically winding a flat coiled filament, locating the longer axis of the flatness to cross the central axis of the double coiled filament at an appropriate angle; (b) a plan view of the double coiled filament formed cylindrical; (c) a plan view of the double coiled filament formed flat cylindrical; and (d) a partly enlarge view of the double coiled filament.
Figure 3:
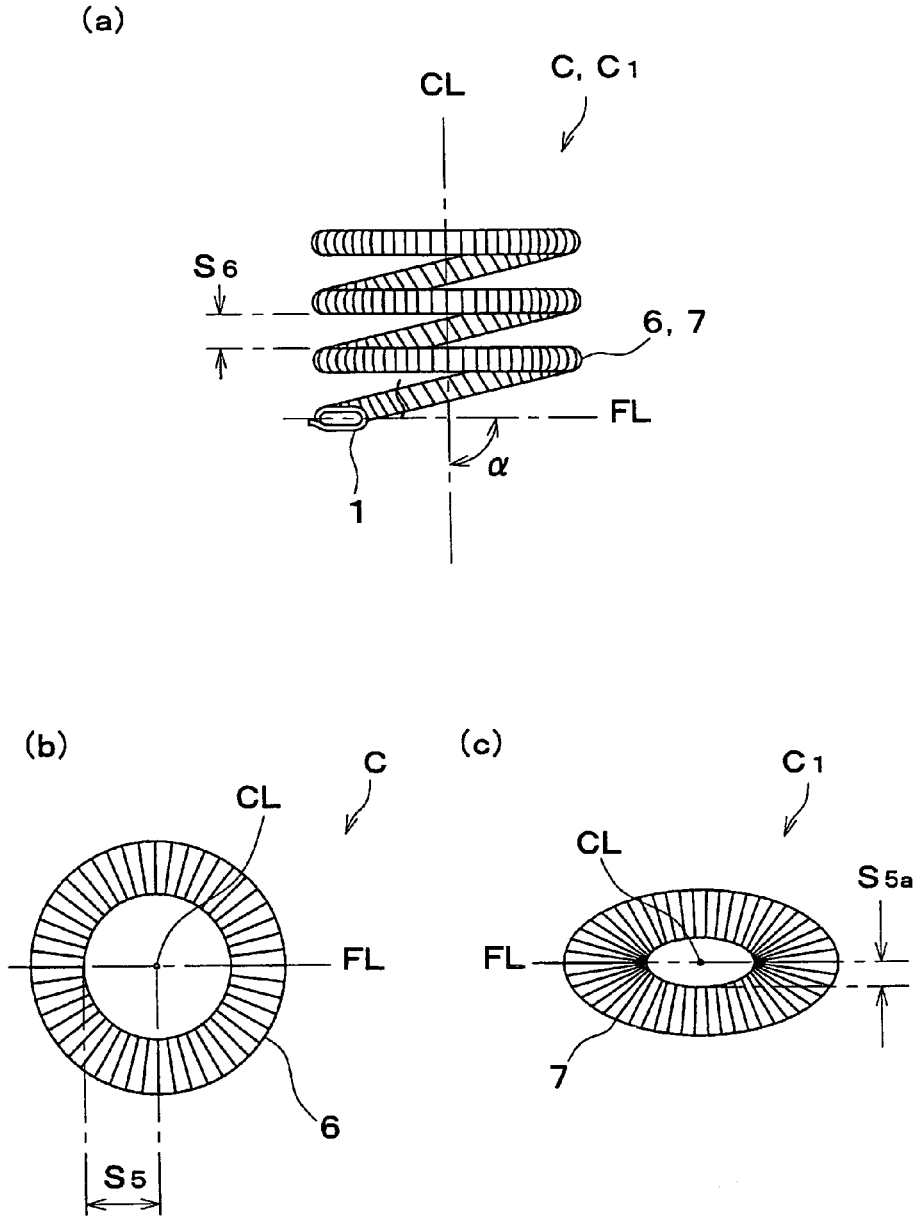
FIG. 3 shows an alternative of the embodiment of FIG. 2: (a) a front view of a double coiled filament formed by helically winding a flat coiled filament, locating the longer axis of the flatness to cross the central axis of the double coiled filament at right angle; (b) a plan view of the double coiled filament formed cylindrical; and (c) a plan view of the double coiled filament formed flat cylindrical.

Second Embodiment (FIGS. 2 and 3)

FIG. 2 shows (a) a front view of a double coiled filament formed by helically winding a flat coiled filament, locating the longer axis of the flatness to cross the central axis of the double coiled filament at an appropriate angle; (b) a plan view of the double coiled filament formed cylindrical; (c) a plan view of the double coiled filament formed flat cylindrical; and (d) a partly enlarge view of the double coiled filament.

As shown in FIG. 2(*a*)–(*d*), a straight flat coiled filament 1 similarly formed as in the first embodiment is employed to form a cylindrical or flat cylindrical double coiled filament 4, 5. In this case, locating the longitudinal axis FL of the flatness to cross the central axis CL of the double coiled filament 4, 5 at an appropriate angle a, the straight flat coiled filament 1 is wound helically to produce an objective coiled filament B, B1.

Also in this case, similar to the first embodiment, spacing S3, S3*a*, between the central axis CL of the double coiled filament 4, 5 and the inner rim of the cylindrical double coiled filament 4 formed in a cylindrical double coil or the inner rim at the shorter side of the flat cylindrical double coiled filament 5 formed in a flat, cylindrical double coiled filament, and spacing S4, between each coil of the helically-wound double coiled filament 4, 5, are designed as narrow as possible outside a range that causes arc-related troubles to increase the amount of filament per unit volume.

When the straight flat coiled filament is employed to form the cylindrical or flat cylindrical double coiled filament 4, 5, for example, it is formed into the flat cylindrical double coiled filament 5 as shown in FIG. 2(*c*), the spacing S3*a* between the inner rim at the shorter side and the central axis CL can be designed much shorter than that in the cylindrical double coiled filament 4. Therefore, if a plurality of cylindrical double coiled filaments having plural central axes are located, arranging the shorter sides in line, it is possible to increase the amount of filament per unit volume by the extent accordingly. This is also similar to the first embodiment.

FIG. 3 shows (a) a front view of a double coiled filament formed by helically winding a flat coiled filament, locating the longer axis of the flatness to cross the central axis of the double coiled filament at right angle; (b) a plan view of the double coiled filament formed cylindrical; and (c) a plan view of the double coiled filament formed flat cylindrical.

As shown in FIG. 3, locating the longer axis FL to cross the central axis CL of the double coiled filament 4, 5 at right angle ($\alpha$=90°), the straight flat coiled filament 1 is wound helically to produce an objective coiled filament C, C1.

Also in this case, similar to the first embodiment, spacing S5, S5*a*, between the central axis CL of the double coiled filament and the inner rim of the cylindrical double coiled filament 6 formed in a cylindrical double coil or the inner rim at the shorter side of the flat cylindrical double coiled filament 7 formed in a flat, cylindrical double coiled filament, and spacing S6, between each coil of the helically-wound double coiled filament 6, 7, are designed as narrow as possible outside a range that causes arc-related troubles to increase the amount of filament per unit volume.

On formation of a double coiled filament, for example, a flat cylindrical double coiled filament as shown in FIG. 3(*c*), the spacing S5*a* between the inner rim at the shorter side and the central axis CL can be designed much shorter than that in the cylindrical double coiled filament 6. Therefore, if cylindrical double coiled filaments having plural central axes are located, arranging the shorter sides in line, it is possible to increase the amount of filament per unit volume by the extent accordingly. This is also similar to the first embodiment.

Figure 4:
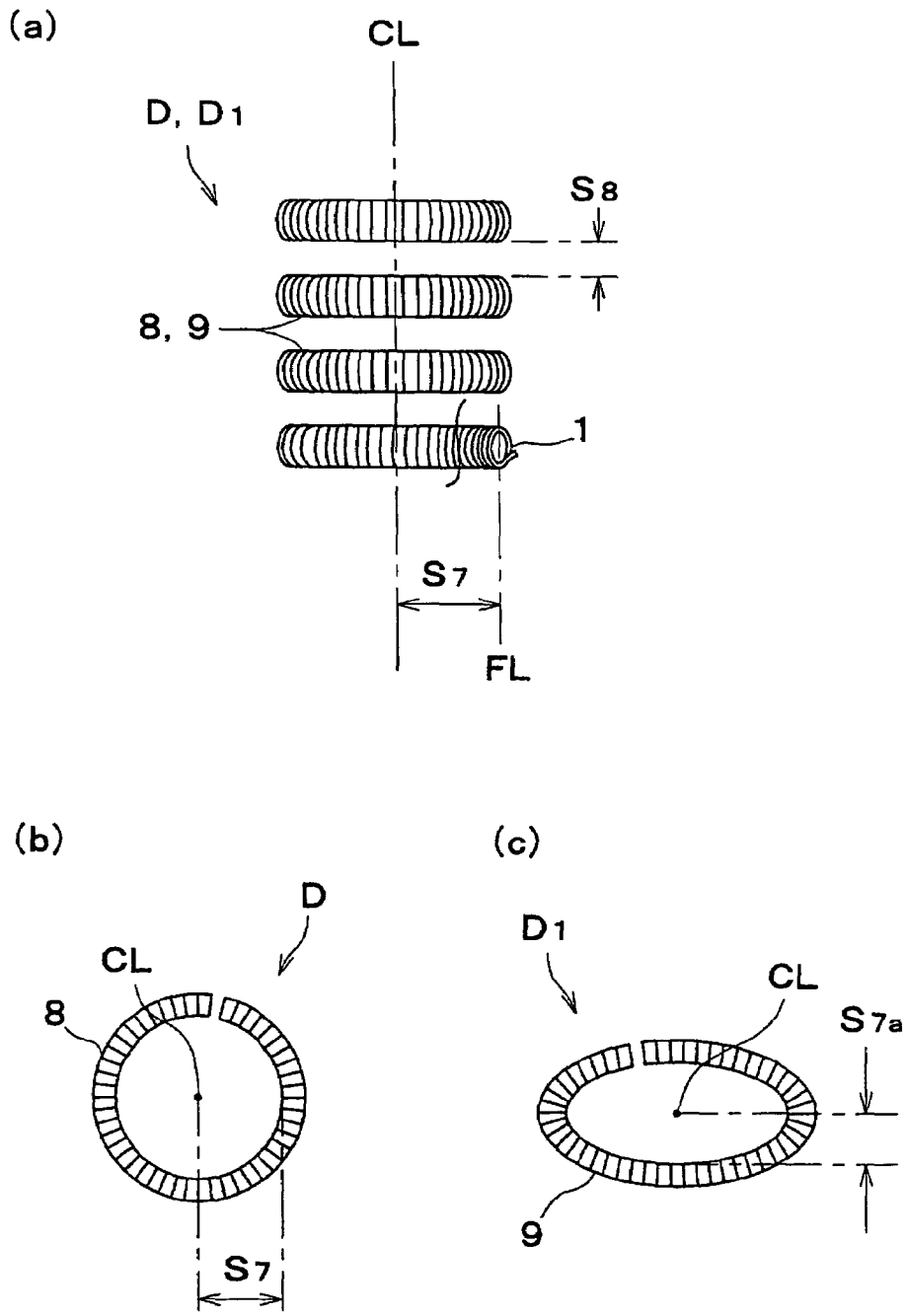
FIG. 4 shows a third embodiment of the coiled filament according to the present invention: (a) a front view of a ring-shaped double coiled filament formed by winding a plurality of ring-shaped straight flat coiled filaments in parallel with the axial direction of the central axis, locating the longer axis of the flatness in parallel with the central axis of the double coiled filament; (b) a plan view of the ring-shaped double coiled filament formed cylindrical; and (c) a plan view of the ring-shaped double coiled filament formed flat cylindrical.

Third Embodiment (FIG. 4)

FIG. 4 shows (a) a front view of a ring-shaped double coiled filament formed by winding a plurality of ring-shaped straight flat coiled filaments in parallel with the axial direction of the central axis, locating the longer axis of the flatness and arranged in parallel with the central axis of the double coiled filament; (b) a plan view of the ring-shaped double coiled filament formed cylindrical; and (c) a plan view of the ring-shaped double coiled filament formed flat cylindrical.

The straight flat coiled filament 1 is ring-shaped to produce a ring-shaped double coiled filament 8, 9. In the ring-shaped double coiled filament 8, 9, the longer axis FL of the flatness in the straight flat coiled filament 1 is located in parallel with the central axis CL of the ring-shaped double coiled filament. In addition, an appropriate number of the ring-shaped double coiled filaments 8, 9 are arranged in parallel with the axial direction of the central axis CL of the ring-shaped double coiled filament to produce an objective coiled filament D, D1.

Also in this case, spacing S7, S7*a*, between the central axis CL of the ring-shaped double coiled filament 8, 9 and the inner rim of the circular ring-shaped double coiled filament 8 formed in a circular and ring-shaped double coil or the inner rim at the shorter side of the flat ring-shaped double coiled filament 9 formed in a flat and ring-shaped double coiled filament, and spacing S8, between each ring of the ring-shaped double coiled filament 8, 9, are designed as narrow as possible outside a range that causes arc-related troubles to increase the amount of filament per unit volume.

On formation of a ring-shaped double coiled filament, for example, a flat ring-shaped double coiled filament formed flat in plane as shown in FIG. 4(*c*), the spacing S7*a* between the inner rim at the shorter side and the central axis CL can be designed much shorter than the spacing S7 in the ring-shaped double coiled filament 8 formed circular in plane. Therefore,if double coiled filaments having plural central axes are located, arranging the shorter sides in line, it is possible to increase the amount of filament per unit volume by the extent accordingly. This is also similar to the first embodiment.

Figure 5:
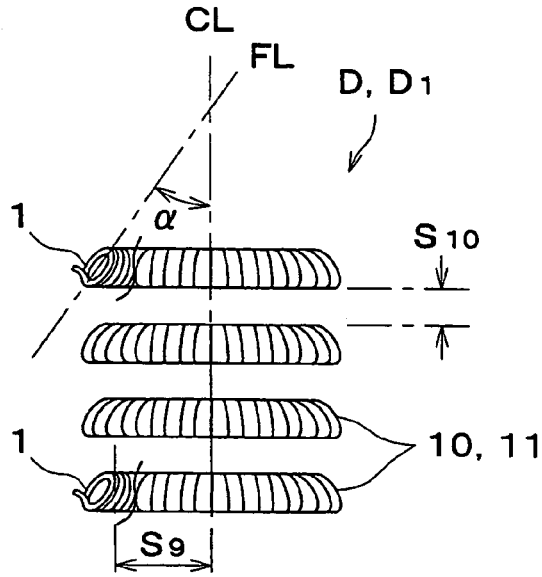
FIG. 5 shows a fourth embodiment of the coiled filament according to the present invention: (a) a front view of a ring-shaped double coiled filament formed by winding a plurality of ring-shaped flat coiled filaments and arranged in parallel with the axial direction of the central axis, locating the longer axis of the flatness to cross the central axis of the double coiled filament at an appropriate angle; (b) a plan view of the ring-shaped double coiled filament formed cylindrical; and (c) a plan view of the ring-shaped double coiled filament formed flat cylindrical.
Figure 5:
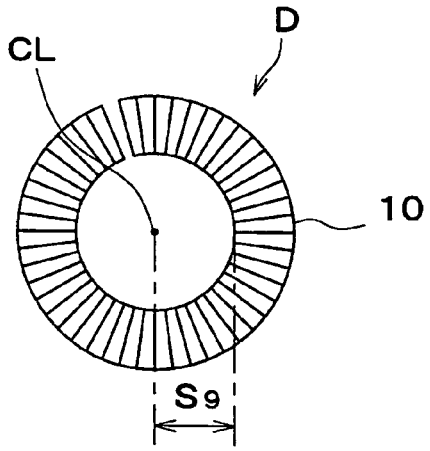
Figure 5:
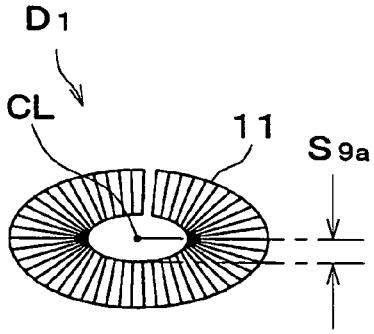
Figure 6:
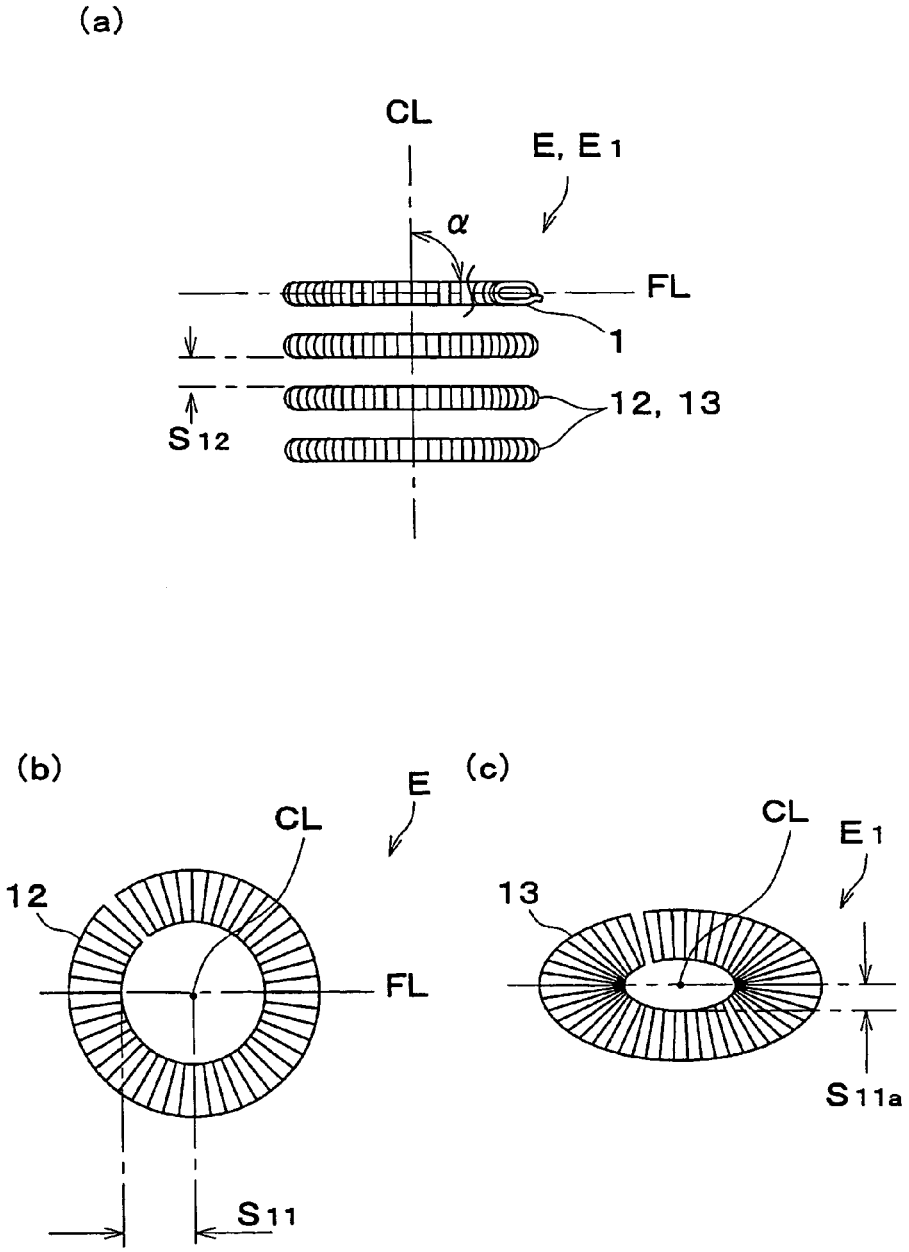
FIG. 6 shows an alternative of the embodiment of FIG. 5: (a) a front view of a ring-shaped double coiled filament formed by winding a plurality of ring-shaped straight flat coiled filaments and arranged in parallel with the axial direction of the central axis, locating the longer axis of the flatness to cross the central axis of the double coiled filament at right angle; (b) a plan view of the ring-shaped double coiled filament formed cylindrical; and (c) a plan view of the ring-shaped double coiled filament formed flat cylindrical.

Fourth Embodiment (FIG. 5 and FIG. 6)

FIG. 5 shows (a) a front view of a ring-shaped double coiled filament formed by winding a plurality of ring-shaped flat coiled filaments and arranged in parallel with the axial direction of the central axis, locating the longer axis of the flatness to cross the central axis of the double coiled filament at an appropriate angle; (b) a plan view of the ring-shaped double coiled filament formed cylindrical; and (c) a plan view of the ring-shaped double coiled filament formed flat cylindrical.

As shown in FIG. 5, the straight flat coiled filament 1 is ring-shaped to produce a ring-shaped double coiled filament 10, 11. In the ring-shaped double coiled filament 10, 11, the longer axis FL of the flatness in the straight flat coiled filament 1 is located to cross the central axis CL of the ring-shaped double coiled filament 10, 11 at an appropriate angle $\alpha$. In addition, an appropriate number of the ring-shaped double coiled filaments 10, 11 are arranged in parallel with the axial direction of the central axis CL thereof to produce an objective coiled filament D, D1.

Also in this case, spacing S9, S9*a*, between the central axis CL of the ring-shaped double coiled filament 10, 11 and the inner rim of the circular ring-shaped double coiled filament 10 formed in a circular and ring-shaped double coil or the inner rim at the shorter side of the flat ring-shaped double coiled filament 11 formed in a flat and ring-shaped double coiled filament, and spacing S10, between each ring of the ring-shaped double coiled filament 10, 11, are designed as narrow as possible outside a range that causes arc-related troubles to increase the amount of filament per unit volume.

On formation of a ring-shaped double coiled filament, for example, a ring-shaped flat double coiled filament 11 formed flat in plane as shown in FIG. 5(*c*), the spacing S9*a* between the inner rim at the shorter side and the central axis CL can be designed much shorter than the spacing S9 in the ring-shaped double coiled filament 10 formed circular in plane. Therefore, if double coiled filaments having plural central axes are located, arranging the shorter sides in line, it is possible to increase the amount of filament per unit volume by the extent accordingly. This is also similar to the first embodiment.

FIG. 6 shows (a) a front view of a ring-shaped double coiled filament formed by winding a plurality of ring-shaped straight flat coiled filaments and arranged in parallel with the axial direction of the central axis, locating the longer axis of the flatness to cross the central axis of the double coiled filament at right angle; (b) a plan view of the ring-shaped double coiled filament formed cylindrical; and (c) a plan view of the ring-shaped double coiled filament formed flat cylindrical.

As shown in FIG. 6, in ring-shaped double coiled filament 12, 13 formed similarly as FIG. 5, the longer axis FL of the flatness in the straight flat coiled filament 1 is located to cross the central axis CL of the ring-shaped double coiled filament 12, 13 at right angle ($\alpha$=90°). In addition, an appropriate number of the ring-shaped double coiled filaments 12, 13 are arranged in parallel with the axial direction of the central axis CL thereof to produce an objective coiled filament E, E1.

Also in this case, spacing S11, S11*a*, between the central axis CL of the ring-shaped double coiled filament 12, 13 and the inner rim of the circular ring-shaped double coiled filament 12 formed in a circular and ring-shaped double coil or the inner rim at the shorter side of the flat ring-shaped double coiled filament 13 formed in a flat and ring-shaped double coiled filament, and spacing S12, between each ring of the ring-shaped double coiled filament 12, 13, are designed as narrow as possible outside a range that causes arc-related troubles to increase the amount of filament per unit volume.

On formation of a ring-shaped double coiled filament, for example, if a flat ring-shaped double coiled filament 13 is formed flat in plane as shown in FIG. 6(*c*), the spacing S11*a* between the inner rim at the shorter side and the central axis CL can be designed much shorter than the spacing S11 in the ring-shaped double coiled filament 12 formed circular in plane. Therefore, if a plurality of ring-shaped double coiled filaments are located, arranging the shorter sides in line, it is possible to increase the amount of filament per unit volume by the extent accordingly.

Figure 7:
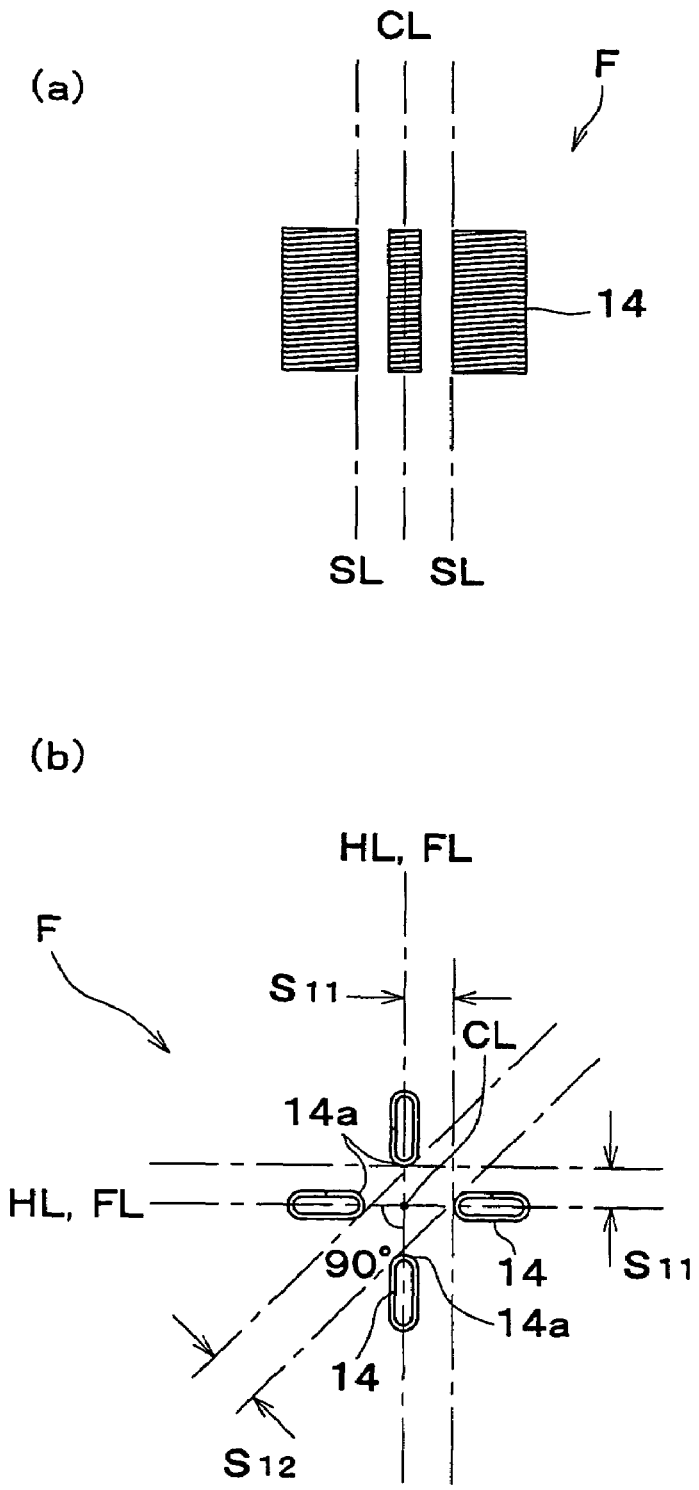
FIG. 7 shows a fifth embodiment of the coiled filament according to the present invention: (a) a front view of a plurality of flat coiled filaments in the form of straight lines arranged in such a state that the straight lines are located in parallel with a pre-determined central axis, and the longer axes of the flatness of the straight flat coiled filaments are located in coincident with the radial directions of the central axis; and (b) a plan view thereof.
Figure 8:
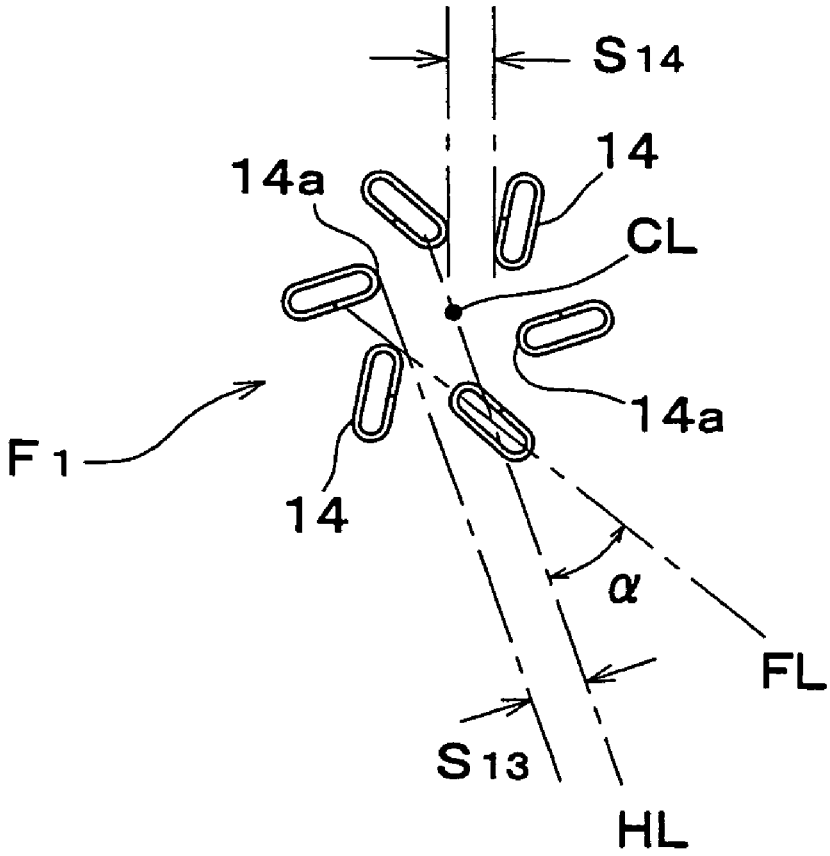
FIG. 8 shows an alternative of the embodiment of FIG. 7 in a plan view of a coiled filament formed by winding a plurality of flat coiled filaments in the form of straight lines in such a state that the straight lines are located in parallel with and at an equal angle to a pre-determined central axis, and the longer axes of the flatness of the straight flat coiled filaments are located to cross the radial directions of the central axis at an appropriate angle.
Figure 9:
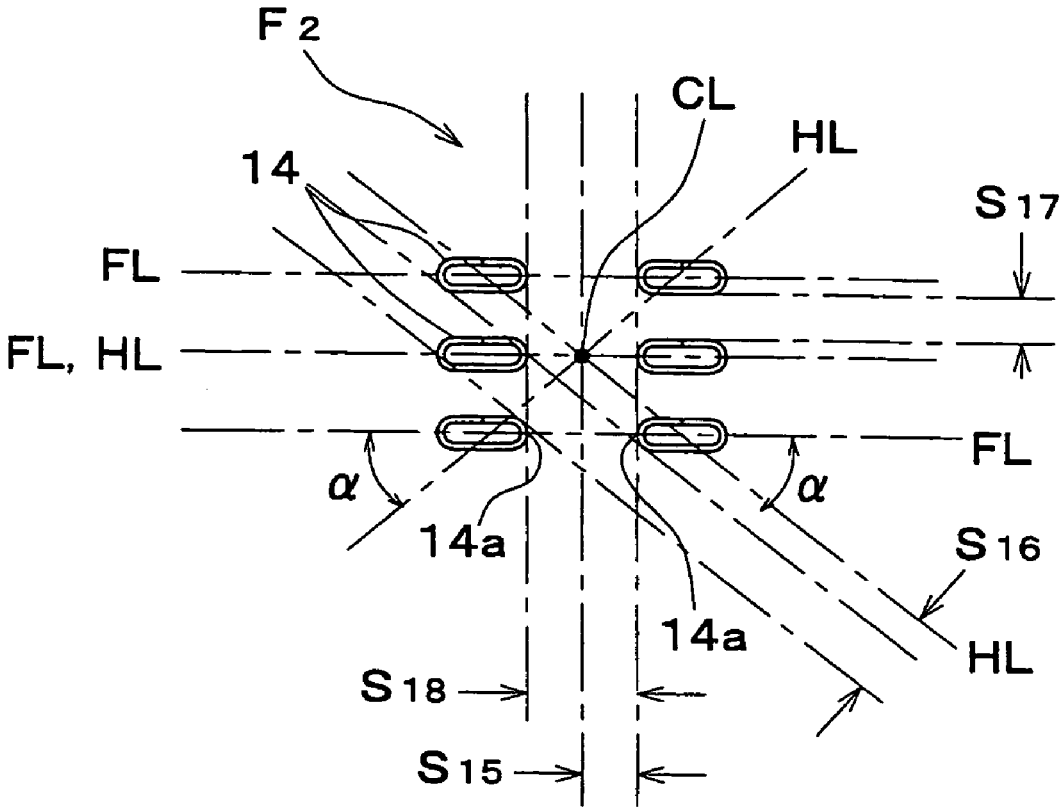
FIG. 9 shows another alternative of the embodiment of FIG. 7 in a plan view of a coiled filament formed by winding a plurality of flat coiled filaments in the form of straight lines in such a state that the straight lines are located in parallel with a pre-determined central axis, and the longer axes of the flatness of the straight flat coiled filaments are located in coincident with the radial directions of the central axis, and to cross the radial directions of the central axis at an appropriate angle, in combination.

Fifth Embodiment (FIGS. 7–9)

FIG. 7 shows (a) a front view of a plurality of flat coiled filaments in the form of straight lines arranged in such a state that the straight lines are located in parallel with a pre-determined central axis, and the longer axes of the flatness of the straight flat coiled filaments are located in coincident with the radial directions of the central axis; and (b) a plan view thereof.

As shown in FIG. 7, four straight flat coiled filaments 14, formed similarly as the first embodiment and appropriately elongated, are arranged in such a state that straight lines SL, which is the axes of the coils of the straight flat coiled filaments, are located in parallel with a pre-determined central axis CL and at every 90-degree about the central axis CL. In addition, the longer axes FL of the flatness of the straight flat coiled filaments 14 are located in coincident with the radial directions HL of the above-mentioned pre-determined central axis CL in the same plane to produce an objective coiled filament F.

FIG. 8 is a plan view of a coiled filament formed by winding a plurality of flat coiled filaments in the form of straight lines in such a state that the straight lines are located in parallel with and at an equal angle to a pre-determined central axis, and the longer axes of the flatness of the straight flat coiled filaments are located to cross the radial directions of the central axis at an appropriate angle.

As shown in FIG. 8, six straight flat coiled filaments 14, formed similarly as FIG. 7 and appropriately elongated, are arranged in such a state that their straight lines (not depicted) are located in parallel with and at equal angle about a pre-determined central axis CL. In addition, the longer axes FL of the flatness of the straight flat coiled filaments 14 are located to cross the radial directions HL of the pre-determined central axis CL at an appropriate angle $\alpha$ in the same plane to produce an objective coiled filament F1.

FIG. 9 is a plan view of a coiled filament formed by winding a plurality of flat coiled filaments in the form of straight lines in such a state that the straight lines are located in parallel with a pre-determined central axis, and the longer axes of the flatness of the straight flat coiled filaments are located in coincident with the radial directions of the central axis, and to cross the radial directions of the central axis at an appropriate angle, in combination.

As shown in FIG. 9, six straight flat coiled filaments 14, formed similarly as FIG. 7 and appropriately elongated, are arranged in such a state that their straight lines (not depicted) are located in parallel with a pre-determined central axis CL. In addition, the longer axes FL of the flatness of the straight flat coiled filaments 14 are partly located in coincident with the radial directions HL of the pre-determined central axis CL in the same plane. At the same time, the longer axes FL are partly located to cross the radial directions HL of the pre-determined central axis CL at an appropriate angle $\alpha$ in the same plane. In such a combination, the six straight flat coiled filaments are arranged in parallel longitudinally and laterally about the central axis CL seen from a plane to produce an objective coiled filament F2.

In either case of FIGS. 7–9, about the pre-determined central axis CL of the coiled filament F, F1, F2, spacing S11, S13, S15, S16 between the central axis CL and one end 14*a* of each flat coiled filament 14 at the central axis CL in the longitudinal direction, and spacing S12, S14, S17, S18 between each flat coiled filament 14 are designed as narrow as possible outside a range that causes arc-related troubles to increase the amount of filament per unit volume.

Figure 10:
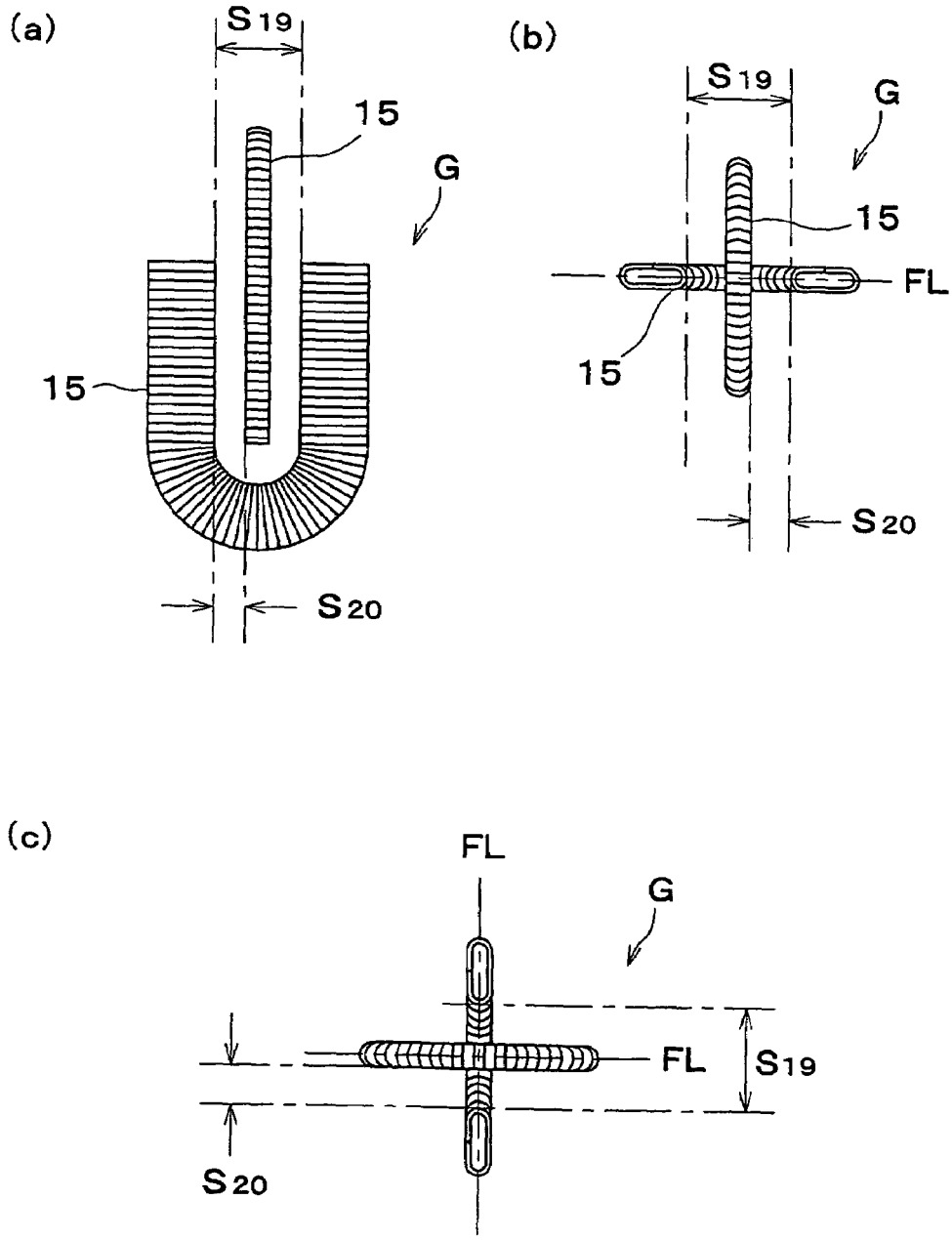
FIG. 10 shows a sixth embodiment of the coiled filament according to the present invention: (a) a front view of a pair of straight flat coiled filaments each U-shaped and inserted into each other through their open ends, crossing the longer axes of the flatness in the U-shaped flat coiled filaments at right angle; (b) a plan view thereof; and (c) a bottom view of (a).
Figure 11:
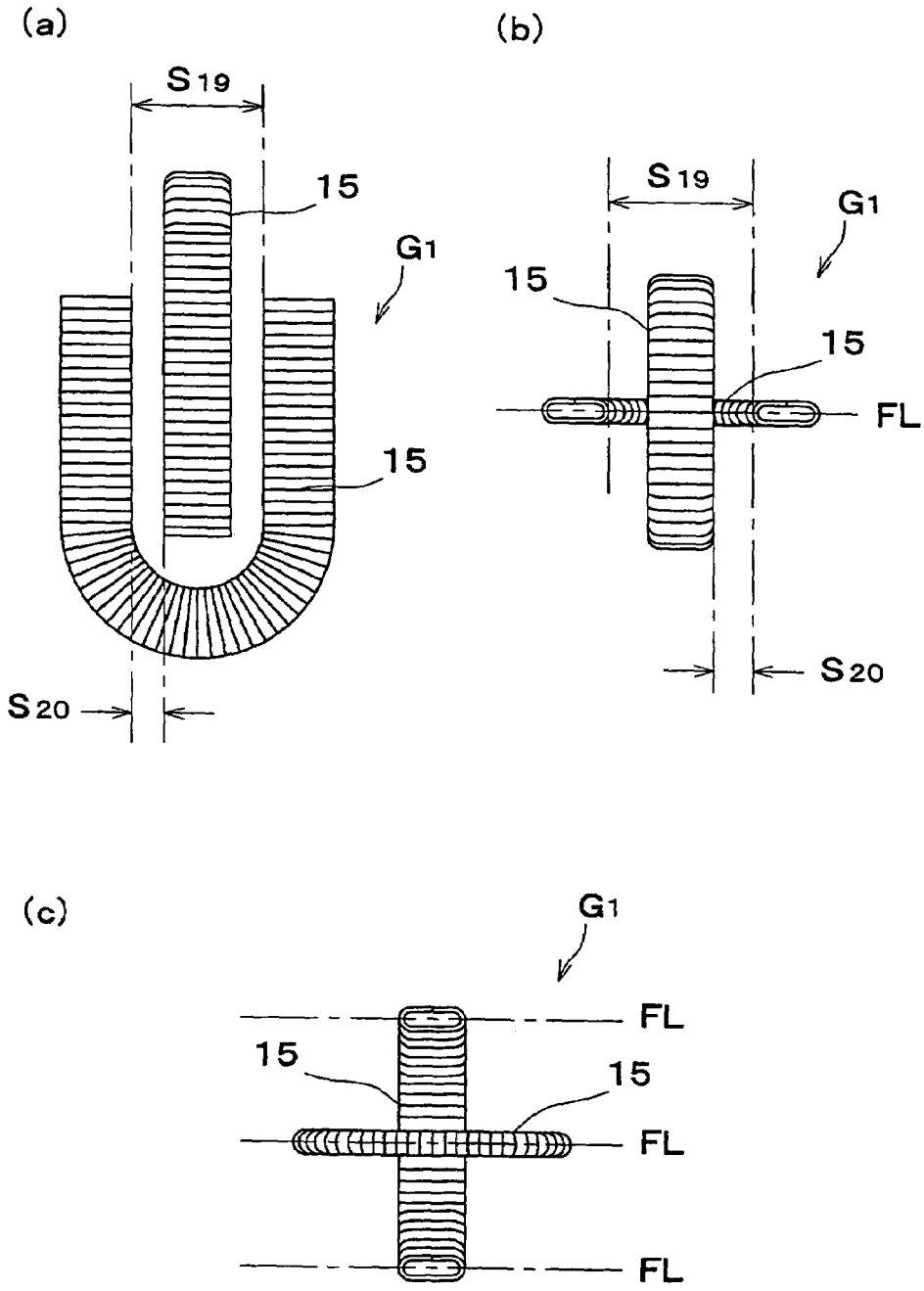
FIG. 11 shows an alternative of the embodiment of FIG. 10: (a) a front view of a pair of U-shaped flat coiled filaments in such a state that the longer axes FL of the flatness in the U-shaped flat coiled filaments are located in parallel; (b) a plan view thereof; and (c) a bottom view of (a).

Sixth Embodiment (FIGS. 10 and 11)

FIG. 10 shows (a) a front view of a pair of straight flat coiled filaments each U-shaped and inserted into each other through their open ends, crossing the longer axes of the flatness in the U-shaped flat coiled filaments at right angle; (b) a plan view thereof; and (c) a bottom view of (a).

As shown in FIG. 10, the straight flat coiled filament, formed similarly as the first embodiment, is further U-shaped. The longer axes FL of the flatness at both open ends of the U-shaped coiled filament 15 are located on the same axis. A pair of the U-shaped coiled filaments 15 are crossed with each other at right angle and mutually inserted through the open ends while keeping the inner surfaces of the closed ends non-contact with each other to produce an objective coiled filament G.

FIG. 11 shows (a) a front view of a pair of U-shaped flat coiled filaments in such a state that the longer axes FL of the flatness in the U-shaped flat coiled filaments are located in parallel; (b) a plan view thereof; and (c) a bottom view of (a).

As shown in FIG. 11, when the pair of the U-shaped coiled filaments 15 of FIG. 10 are mutually inserted through the open ends, the longer axes FL of the flat coiled filaments are arranged in parallel to produce an objective coiled filament G1.

In the cases of FIGS. 10–11, either of the pair of the U-shaped coiled filaments 15 may be plural, or one may be plural and the other single. The spacing S19 between the inner surfaces of the U-shaped coiled filament 15 in the coiled filament G, G1 and the spacing S20 between the U-shaped coiled filaments 15 are designed as narrow as possible outside a range that causes arc-related troubles to increase the amount of filament per unit volume.

Figure 12:
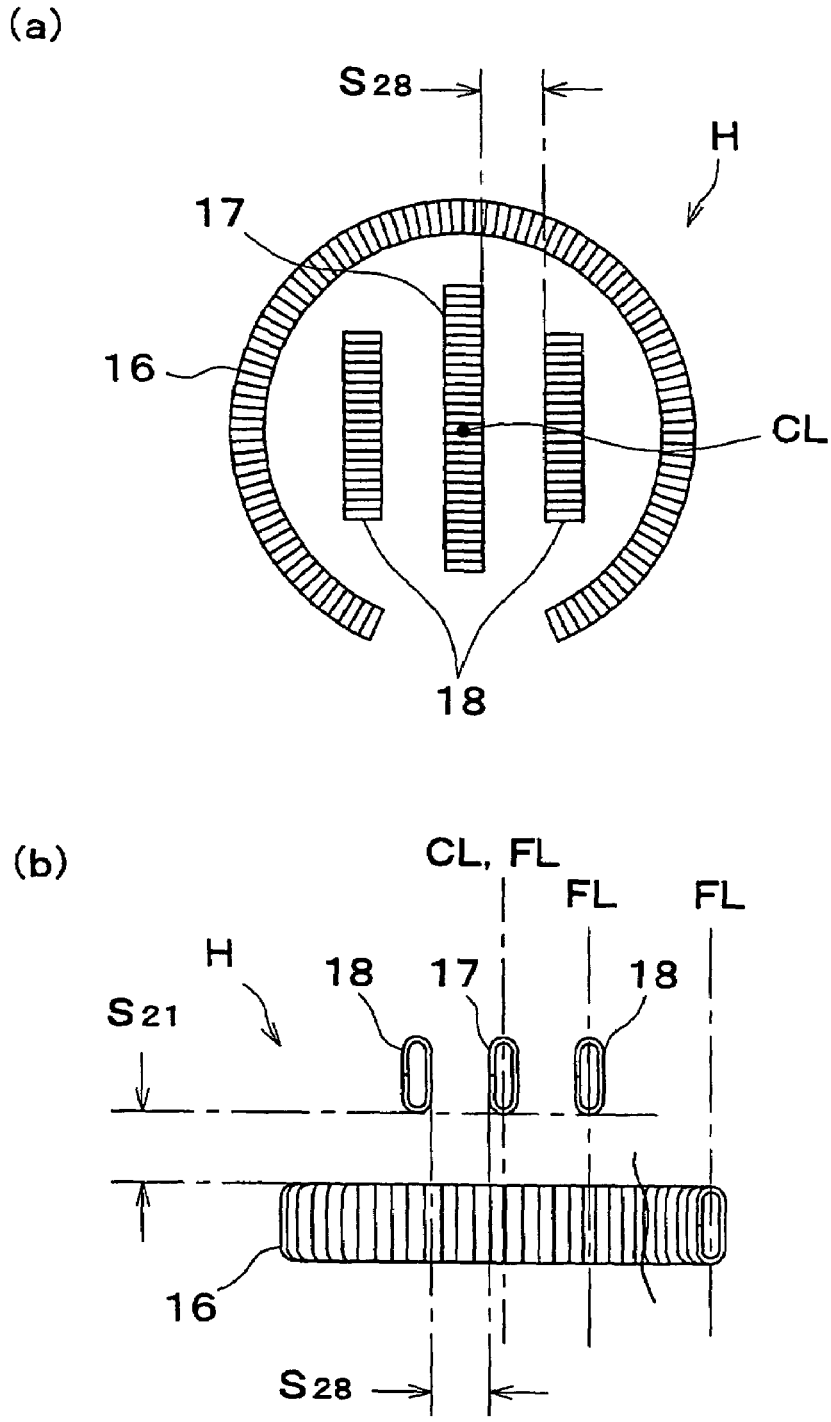
FIG. 12 shows a seventh embodiment of the coiled filament according to the present invention: (a) a front view of a straight flat coiled filament formed circular in such a state that the circular ring-shaped double coiled filament contains flat coiled filaments within its circle; and (b) a plan view of (a) partly cut-off.
Figure 13:
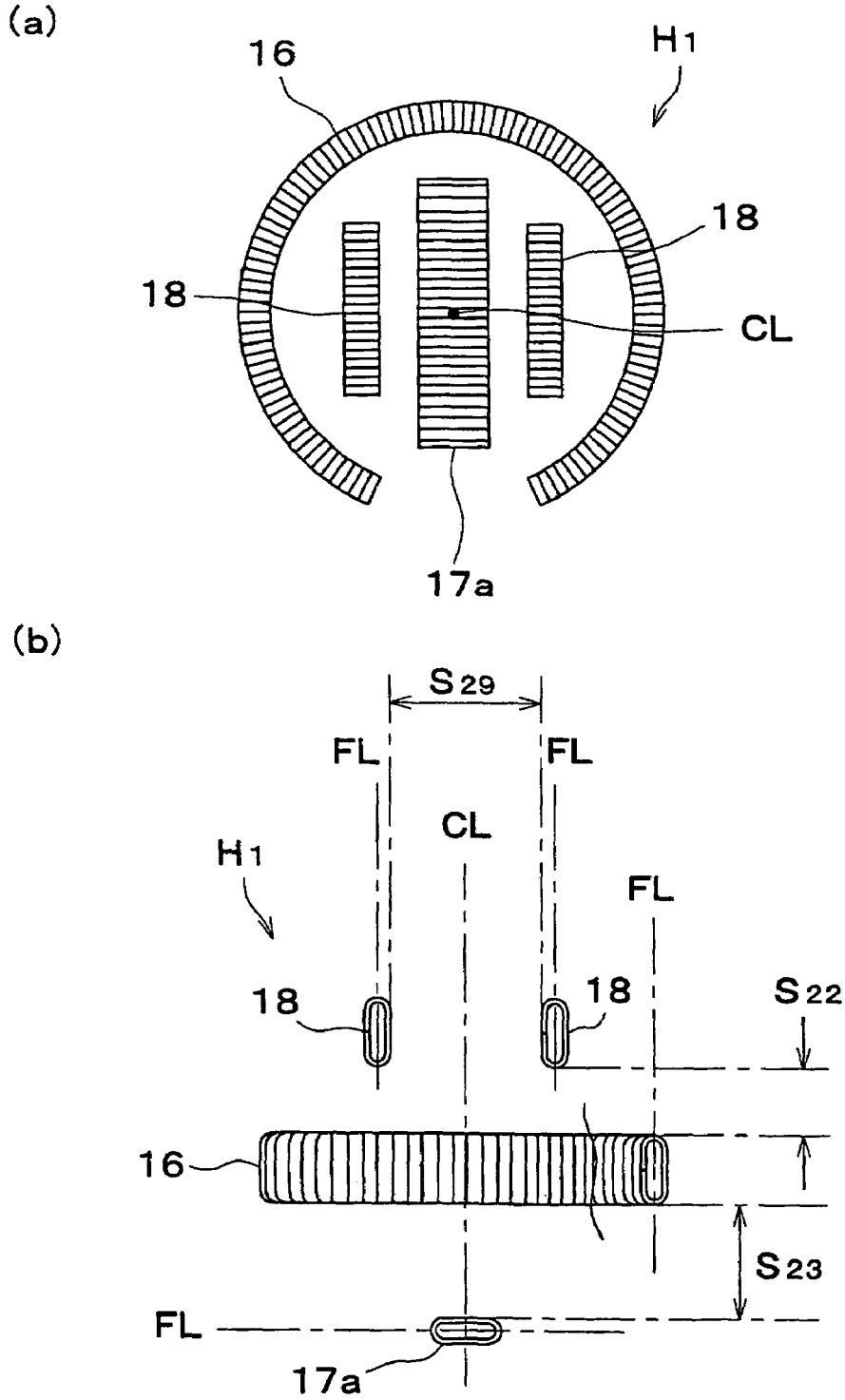
FIG. 13 shows an alternative of the embodiment of FIG. 12: (a) a front view in such a state that the straight flat coiled filament at the center in FIG. 12(*a*) is turned to a different direction and located in front of the circular ring-shaped double coiled filament; and (b) a plan view of (a) partly cut-off.
Figure 14:
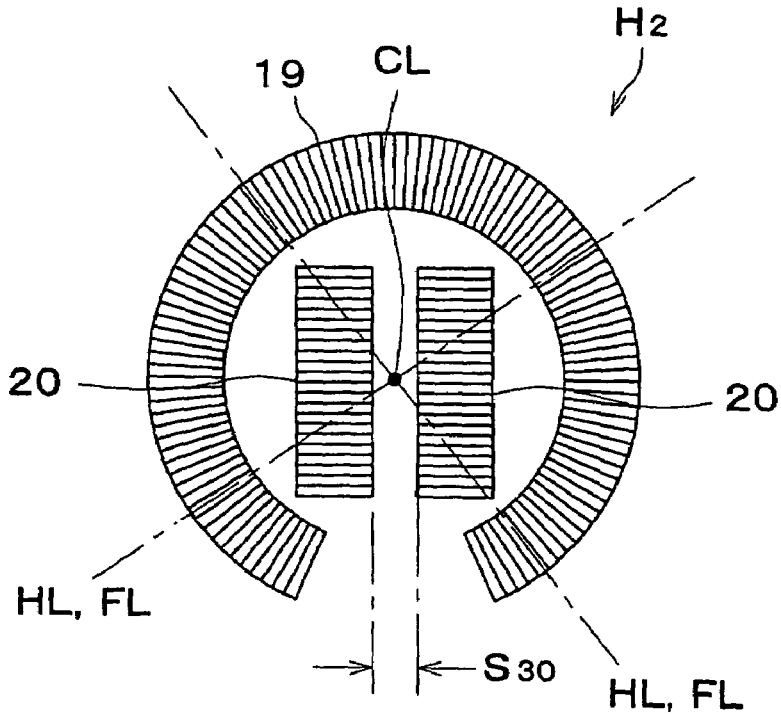
FIG. 14 shows another alternative of the embodiment of FIG. 12: (a) a front view in such a state that the straight flat coiled filament at the center in FIG. 13(*a*) is removed, and the circular ring-shaped double coiled filament and the straight flat coiled filaments located within the circle are turned to a different direction; and (b) a bottom view thereof.
Figure 14:
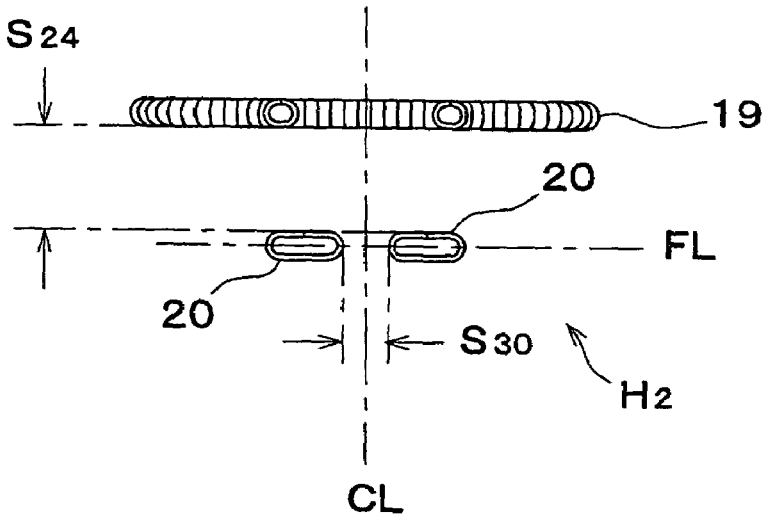

Seventh Embodiment (FIGS. 12–14)

FIG. 12 shows (a) a front view of a straight flat coiled filament formed circular in such a state that the circular ring-shaped double coiled filament contains flat coiled filaments within its circle; and (b) a plan view of (a) partly cut-off.

As shown in FIG. 12, the straight flat coiled filament, formed similarly as the first embodiment, is further formed circular to produce a circular ring-shaped double coiled filament 16.

With in the circle of the circular ring-shaped double coiled filament 16, at the rear along the central axis CL of the circle, three straight flat coiled filaments 17, 18 are arranged at an equal interval. As for the circular ring-shaped double coiled filament 16, the longer axis FL of the flatness is located in parallel with the central axis CL of the circle. As for the three straight flat coiled filaments 17, 18 that are arranged at the rear along the central axis CL of the circle, the longer axes FL of the flatness are located in parallel with the central axis CL of the circle. Among the straight flat coiled filaments 17, 18, the straight flat coiled filament 17 at the center has a length slightly shorter than the inner diameter of the circle. The straight coiled filaments 18 located at both sides have shorter lengths than a length that contacts the extension of the inner rim of the circle to produce an objective coiled filament H.

FIG. 13 shows (a) a front view in such a state that the straight flat coiled filament at the center in FIG. 12(*a*) is turned to a different direction and located in front of the circular ring-shaped double coiled filament; and (b) a plan view of (a) partly cut-off.

As shown in FIG. 13, among the three straight flat coiled filaments 17*a*, 18 in FIG. 12, as for the straight flat coiled filament l7*a* at the center, the longer axis FL of the flatness is located to cross the center axis CL of the circular ring-shaped double coiled filament 16. In addition, it is located at the front of the circular ring-shaped double coiled filament 16 as a straight flat coiled filament 17*a* to produce an objective coiled filament H1.

FIG. 14 shows (a) a front view in such a state that the straight flat coiled filament at the center in FIG. 13(*a*) is removed, and the circular ring-shaped double coiled filament and the straight flat coiled filaments located within the circle are turned to a different direction; and (b) a bottom view thereof.

As shown in FIG. 14, among the three straight flat coiled filaments 17, 18 in FIG. 12, the straight flat coiled filament 17 at the center is removed. Matching the longer axis FL of the flatness of the straight flat coiled filament with the radial direction HL of the central axis CL of the circular ring-shaped double coiled filament 16 in the same plane, the circular ring-shaped double coiled filament 16 is formed into a circular ring-shaped double coiled filament 19. Within the circle of the circular ring-shaped double coiled filament 19, a pair of straight flat coiled filaments 20 are arranged at an appropriate interval. In addition, the longer axis FL of the flatness of the straight flat coiled filament 20 is located behind the circular ring-shaped double coiled filament 19 to cross the central axis CL at right angle to produce an objective coiled filament H2.

In either case of FIGS. 12–14, spacing S21–S24 between the circular ring-shaped double coiled filament 16, 19 and the straight flat coiled filament 17, 18, 20, and spacing S28–S30 between the straight flat coiled filaments 17, 18, 20 are designed as narrow as possible outside a range that causes arc-related troubles to increase the amount of filament per unit volume.

In addition, as for the circular ring-shaped double coiled filament 16, 19 and the straight flat coiled filament 17, 18, 20 arranged within the circle thereof, their lengths and sizes can be formed appropriately within an effective range that does not interfere with each other at the illumination in the illuminated field to produce an objective coiled filament H, H1, H2.

Figure 15:
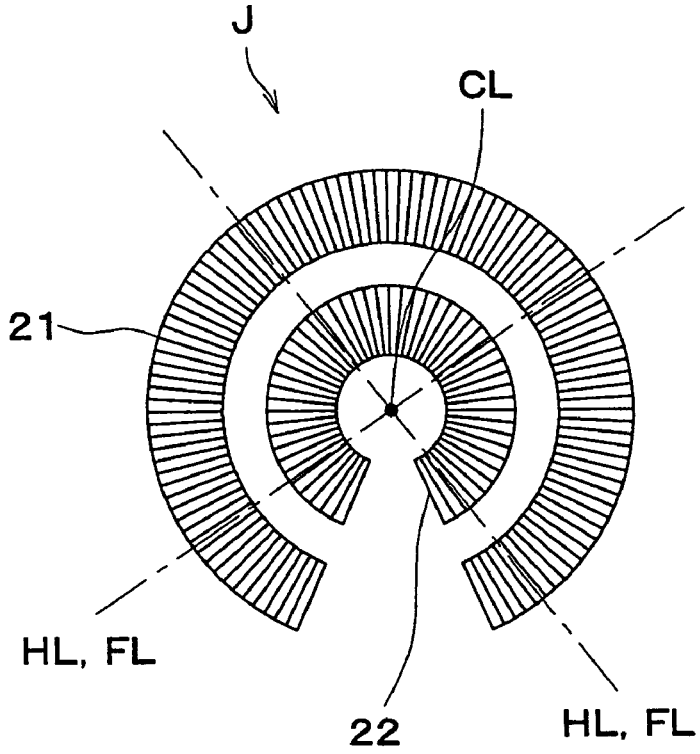
FIG. 15 shows an eighth embodiment of the coiled filament according to the present invention: (a) a front view in such a state that the longer axis of the flatness of a straight flat coiled filament is located in coincident with the radial direction of the central axis of the circle of a circular ring-shaped double coiled filament, and within the circle, a similarly-formed smaller-diameter circular ring-shaped double coiled filament is located coaxially; and (b) a cross-sectional view taken across the center thereof.
Figure 15:
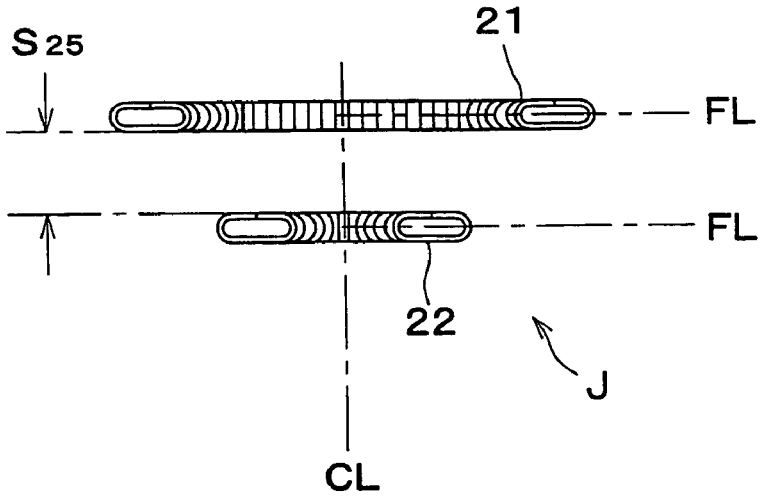
Figure 16:
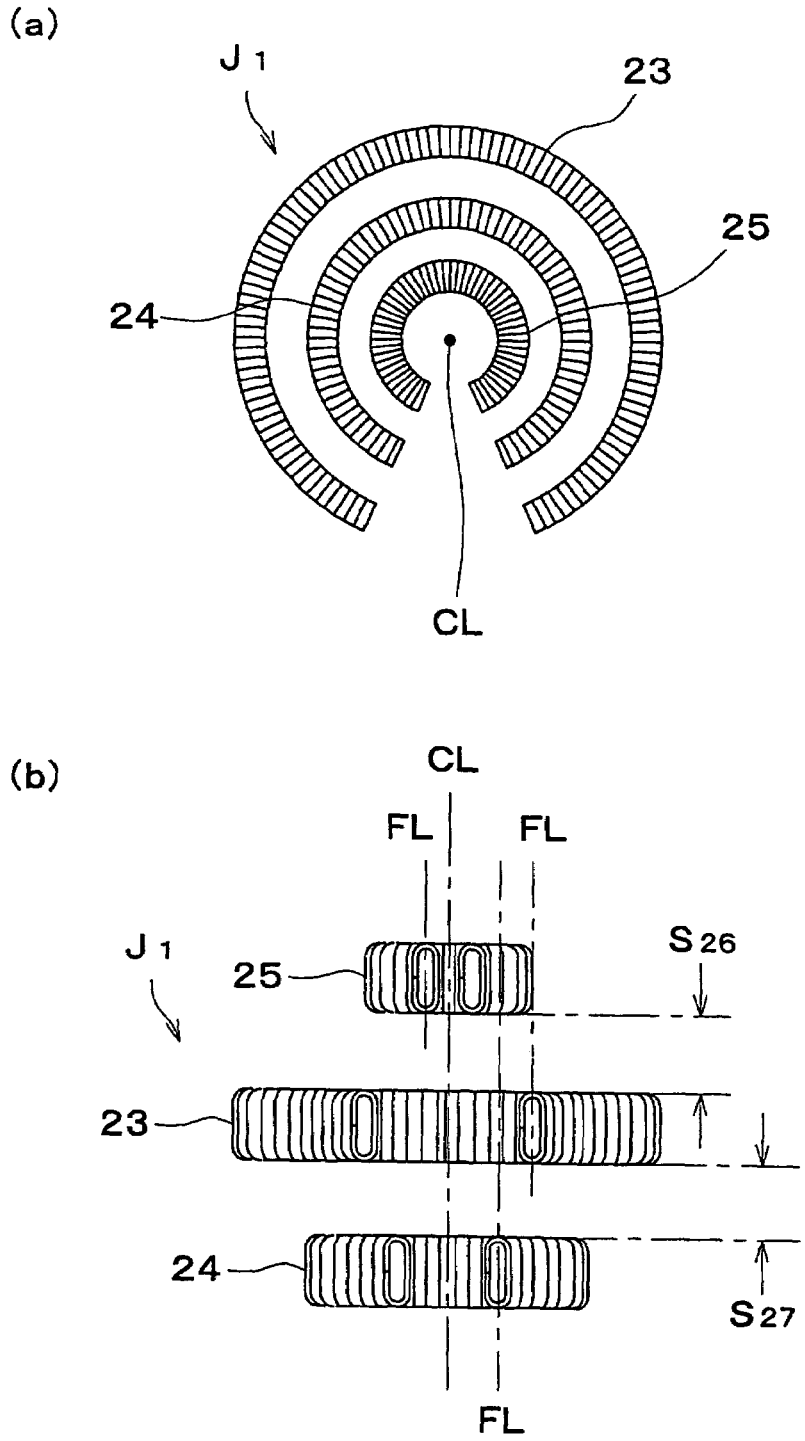
FIG. 16 shows an alternative of the embodiment of FIG. 15: (a) a front view in such a state that the longer axis of the flatness of the circular ring-shaped double coiled filament is located in parallel with the central axis of the circle of the circular ring-shaped double coiled filament, and within the circle, a pair of similarly-formed different-diameter circular ring-shaped double coiled filaments are located coaxially; and (b) a bottom view thereof.

Eighth Embodiment (FIGS. 15 and 16)

FIG. 15 shows (a) a front view in such a state that the longer axis of the flatness of a straight flat coiled filament is located in coincident with the radial direction of the central axis of the circle of a circular ring-shaped double coiled filament, and within the circle, a similarly-formed smaller-diameter circular ring-shaped double coiled filament is located coaxially; and (b) a cross-sectional view taken across the center thereof.

As shown in FIG. 15, the straight flat coiled filament, formed similarly as the first embodiment, is employed to produce a circular ring-shaped double coiled filament 21, matching the longer axis FL of the flat coiled filament with the radial direction HL of the central axis CL of the circular ring-shaped double coiled filament 21 in the same plane. Within the circle of the circular ring-shaped double coiled filament 21, behind along and coaxially about the central axis CL of the circle, a circular ring-shaped double coiled filament 22 with a smaller diameter compared to the circular ring-shaped double coiled filament 21 is arranged to produce an objective coiled filament J.

FIG. 16 shows (a) a front view in such a state that the longer axis of the flatness of the circular ring-shaped double coiled filament is located in parallel with the central axis of the circle of the circular ring-shaped double coiled filament, and within the circle, a pair of similarly-formed different-diameter circular ring-shaped double coiled filaments are located coaxially; and (b) a bottom view thereof.

As shown in FIG. 16, the circular ring-shaped double coiled filament of FIG. 15 is modified such that the longer axis FL of the flatness is located in parallel with the central axis CL of the circle of the circular ring-shaped double coiled filament, to produce a circular ring-shaped double coiled filament 23. Within the circle of the circular ring-shaped double coiled filament 23, before and behind the circular ring-shaped double coiled filament 23 along the central axis CL, a pair of circular ring-shaped double coiled filaments 24, 25 with different diameters are arranged to produce an objective coiled filament J1.

In either case of FIGS. 15 and 16, spacing S25–S27 between the circular ring-shaped double coiled filaments 21 and 22, and 23, 24 and 25 are designed as narrow as possible outside a range that causes arc-related troubles to increase the amount of filament per unit volume.

In addition, as for the basic circular ring-shaped double coiled filaments 21, 23 and the smaller-diameter circular ring-shaped double coiled filament 22, 24, 25 arranged within the circle thereof, their lengths and sizes can be formed appropriately within an effective range that does not interfere with each other at the illumination in the illuminated field to produce an objective coiled filament.

As described above, according to the coiled filament of the present invention, it is possible to increase the amount of filament per unit volume compared to the conventional coiled filament. Therefore, it is possible to reduce the volume of the light emitter in a coiled filament. This is effective to serve in downsizing a light bulb and improve the illumination per unit area with high efficiency in an illuminated field without variations.

What is claimed is:

1. A coiled filament comprising a straight fiat coiled filament wound into flatness in the form of a straight line and formed of a plurality of coils wound flat, wherein the longer axis of said flatness is located in parallel with the central axis of a double coiled filament formed by further winding said straight flat coiled filament, and said coils which are wound flat are arranged helically about said central axis, wherein the coiled filament is formed of a plurality of coils wound flat wherein each coil is non-circular having a major axis and a minor axis.

2. The coiled filament according to claim 1, wherein said straight flat coiled filament is ring-shaped about the central axis of said double coiled filament, and a plurality of such ring-shaped flat coiled filaments are arranged in parallel with the axial direction of said central axis.

3. The coiled filament according to claim 1, wherein said flattened coils have a major axis and a minor axis.

4. The coiled filament according to claim 1, wherein said flattened coils have a major axis parallel to said central axis and a minor axis perpendicular to said central axis.

5. The coiled filament according to claim 1, wherein said flattened coils is are elliptical.

6. A coiled filament comprising a plurality of flat coiled filaments wound into flatness in the form of straight lines and formed of a plurality of coils wound flat, wherein said straight lines are located in parallel with a pre-determined central axis, and the longer axes of said flatness of said straight flat coiled filaments are located at an appropriate angle to cross the radial directions of said pre-determined central axis including said radial direction, wherein said coils which are wound flat are arranged helically about said pre-determined central axis, wherein the coiled filament is formed of a plurality coils wound flat wherein each coil is non-circular having a major axis and a minor axis.

7. The coiled filament according to claim 6, wherein said flattened coils have a major axis and a minor axis.

8. The coiled filament according to claim 6, wherein said flattened coils have a major axis parallel to said central axis and a minor axis perpendicular to said central axis.

9. The coiled filament according to claim 6, wherein said flattened coils are elliptical.

* * * * *